US005565747A

United States Patent [19]

Sasaki et al.

[11] Patent Number: 5,565,747

[45] Date of Patent: Oct. 15, 1996

[54] MAGNETIC FIELD GENERATOR FOR USE WITH INSERTION DEVICE

[75] Inventors: Shigemi Sasaki, Ibaraki-ken; Koji Miyata; Takeo Takeda, both of Fukui-ken, all of Japan

[73] Assignee: Japan Atomic Energy Research Institute, Tokyo, Japan

[21] Appl. No.: 532,223

[22] Filed: Sep. 22, 1995

Related U.S. Application Data

[63] Continuation of Ser. No. 51,776, Apr. 26, 1993, abandoned.

[30] Foreign Application Priority Data

Apr. 28, 1992 [JP] Japan ..... 4-110236

[51] Int. Cl.[6] ..... H01J 23/10

[52] U.S. Cl. ..... 315/507; 315/503

[58] Field of Search ..... 315/500–506, 315/507

[56] References Cited

U.S. PATENT DOCUMENTS

| | | | |
|---|---|---|---|
| H450 | 3/1988 | Halbach | 330/4 |
| 4,523,168 | 6/1985 | Emanuelson et al. | 335/296 |
| 4,731,598 | 3/1988 | Clarke | 335/210 |
| 4,764,743 | 8/1988 | Leupold et al. | 335/306 |
| 4,800,353 | 1/1989 | Csonka et al. | 335/210 |
| 4,819,238 | 4/1989 | Harvey | 372/2 |
| 4,888,776 | 12/1989 | Dolezal et al. | 372/2 |
| 4,977,384 | 12/1990 | Tatchyn et al. | 505/213 |
| 5,099,217 | 3/1992 | Leupold | 335/306 |
| 5,263,035 | 11/1993 | Leboutet et al. | 372/2 |
| 5,351,248 | 9/1994 | Iracane | 372/2 |
| 5,384,794 | 1/1995 | Takanaka | 372/2 |
| 5,483,129 | 1/1996 | Yamamoto | 315/503 |

OTHER PUBLICATIONS

Elleaume; A Flexible Planar/Helical Undulator For Synchrotron Sourles; 1990; pp. 371–377.

Robinson et al. "Development Of A 10–M Wedged–Pole Undulator" IEEE 1989 pp. 783–785.

Viccaro et al. "Magnetic Field Tolerances For Insertion Devices On Third Generation Synchrotron Light Sources" IEEE 1991 pp. 1091–1095.

Rakowsky et al. "Performance Of Rocketdyne Phase–Optimized Pure Permanent Magnet Undulator" IEEE 1991 pp. 2733–2735.

Barthe's et al. "Magnet Developments For The New Orsay Synchrotron Source Super ACO" IEEE 1988.

Onuki; Elliptically Polarized Synchrotron Radiation Source With Crossed And Retarded Magnetic Fields; 1986, pp. 94–98.

Halbach; Physical And Optical Properties Of Rare Earth Cobalt Magnets; 1981; pp. 109–117.

Kim; A Synchrotron Radiation Source With Arbitrarily Adjustable Ellipitical Polorization; 1984; pp. 425–429.

Elleaume; A Flexible Planar/Helical Undulator Design For Synchrotron Sources; 1990; pp. 371–377.

Sasaki et al.; A New Undulator For Generating Variably Polarized Radiation; 1992; pp. 1794–1796.

*Primary Examiner*—Alvin E. Oberley
*Assistant Examiner*—Lawrence O. Richardson
*Attorney, Agent, or Firm*—Banner & Allegretti, Ltd.

[57] ABSTRACT

A magnetic field generator for use with an insertion device, which comprises four magnet arrays, two of the arrays being provided .above the plane of an electron orbit and the other two magnet arrays being provided below the plane, said magnet arrays being provided in such a manner that they are symmetric to each other with respect to the axis of the electron orbit is described.

18 Claims, 2 Drawing Sheets

MAGNETIC FIELD GENERATOR FOR USE WITH INSERTION DEVICE

This is a continuation of application Ser. No. 08/051,776 filed Apr. 26, 1993, now abandoned.

BACKGROUND OF THE INVENTION

This invention relates to a magnetic field generator for use with an insertion device in order to produce radiations having various polarization characteristics, as well as a method for generating magnetic fields and a method of producing polarized radiation.

It is well known that when high-energy electrons accelerated by a particle accelerator such as a synchrotron are subjected to motion in a periodic magnetic field, radiation of high directivity and very high luminance are produced over a spectral range from the ultra-violet to X-ray region. In particular, undulator radiation is very useful since it is 2–4 times more intense in magnitude than the light emitted from bending magnets and is quasimonochromatic. Such radiation is produced by means of a special light source called an "insertion device".

Conventional insertion devices consist merely of two sets of magnet arrays, each set being provided above and below the plane of an electron orbit in order to generate sinusoidal periodic magnetic fields, thereby producing a horizontally polarized radiation, or radiation polarized linearly in a horizontal plane. In certain applications, increasing use is made of either vertically polarized radiation, or radiation polarized linearly in a plane perpendicular to the plane of an electron orbit (vertical plane), or circularly polarized radiation. Consider, for example, fields such as structural phase transfer, diffuse scattering and biopolymers, the vertically polarized light is used in these applications whereas the circularly polarized light is used in other fields such as magnetic scattering and solid electron spectrometry. Kwang J. Kim, Nucl. Inst. Meth, Phys. Res. 219(1984) 425–429 reported an insertion device in which, two sets of magnet arrays are provided, one set being horizontal magnet arrays and the other being vertical arrays, so that two sinusoidal periodic magnetic fields are crossed at right angles on the axis of an electron orbit to produce elliptically or circularly polarized radiation.

It is theoretically impossible to produce circularly polarized radiation with the first type of insertion device. On the other hand, it has been impossible for the second type of insertion device to pick up radiation at a wavelength as short as those obtainable from the first type. This is because the period length of periodic magnetic fields must be increased in order to attain a sufficient field strength on electron orbits to withstand practical applications.

The second type of insertion device permits the gap in the horizontal direction to be made as small as the gap in the vertical direction and, hence, it is theoretically possible to produce satisfactory magnetic fields on electron orbits at short wavelengths. However, the second type of insertion device is limited in its ability to generate an even stronger magnetic field on electron orbits by reducing the distance between the magnet arrays on the right and left sides of an electron orbit. This is because the aperture for electron beams in the horizontal plane is limited by those two magnet arrays. A further problem with the second type of insertion device is that no satisfactory degree of circular polarization can be achieved if electron beams are divergent (accelerated electron beams are divergent in all cases).

SUMMARY OF THE INVENTION

It is therefore, an object of the present invention to provide a magnetic field generator for use with an insertion device that is capable of producing radiation without limiting the aperture of electron beams in the horizontal direction.

Another object of the present invention is to provide a method for generating various periodic magnetic fields such as a spiral magnetic field of satisfactory strength on electron orbits.

A further object of the present invention is to provide a method for producing radiation having desired polarization characteristics such as circular polarization or vertical linear polarization over a wide spectral range from the visible to X-ray region including the short wavelength region which has been difficult to achieve by the prior art.

These objects of the present invention can be attained by a design in which two magnet arrays for generating sinusoidal periodic magnetic fields are provided both above and below the plane of an electron orbit, and a set of magnet arrays that are provided on a diagonal line with respect to the axis of an electron orbit is shifted along the axis of an electron orbit with respect to the position of the other set of magnet arrays.

The present invention is capable of generating various periodic magnetic fields including a spiral field, a horizontal field and a vertical field, thereby producing radiation having desired polarization characteristics such as circular polarization, elliptic polarization, vertical polarization and horizontal polarization. In order to produce an elliptically polarized and a circularly polarized radiation, the conventional insertion device has been designed in such a way that not only are a set of magnet arrays provided above and below an electron orbit but another set of magnet arrays are also provided on the right and left sides of an electron orbit for the purpose of generating a magnetic field that is perpendicular to the first set of magnet arrays. The major advantage of the system of the present invention is that a spiral magnetic field even stronger than that obtainable from the conventional version can be generated on electron orbits without limiting the aperture of electron beams in the horizontal plane.

The magnetic field generator of the present invention can be inserted into various kinds of electron beam accelerators such as a linear accelerator, a Van de Graaff accelerator and a storage ring so as to pick up radiations over a wide range of wavelengths or for the purpose of using the system of interest as a free electron laser.

DESCRIPTION OF THE PREFERRED EMBODIMENTS

Figure 1:
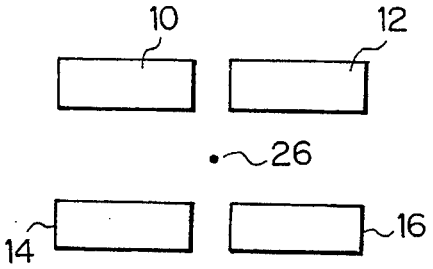
FIG. 1 is a schematic cross-sectional view of the magnet arrays to be used in the present invention.

The magnetic field generator of the present invention for use with an insertion device comprises magnet arrays for generating sinusoidal periodic magnetic fields. Sinusoidal periodic magnetic fields are generated by means of a set of magnet arrays. In the present invention, two sets of magnet arrays, namely, four magnet arrays are used. The magnet arrays are provided in such a way that they are located only above and below an electron orbit. Stated more specifically, two magnet arrays are provided above the plane of an electron orbit and, similarly, two other magnet arrays are provided below the plane of an electron orbit. An embodiment of the present invention is shown in FIG. 1. Two magnet arrays 10 and 12 are provided above the plane of an electron orbit 26, whereas two other magnet arrays 14 and 16 are provided below the plane of electron orbit 26. The four magnet arrays are disposed to be symmetric to each other with the axis of the electron orbit 26. The term "a set of magnet arrays" as used herein shall mean two magnet arrays that are positioned on a diagonal line with respect to the axis of an electron orbit. Take, for example, the case shown in FIG. 1; either the combination of magnet arrays 10 and 16 or the combination of magnet arrays 12 and 14 forms a set of magnet arrays and thereby generating sinusoidal periodic magnetic fields. The axis of the electron orbit 26 is positioned on the point where two diagonal lines cross each other. The two sets of magnet arrays 10/16 and 12/14 will generate sinusoidal periodic magnetic fields on the electron orbit 26. The periodic magnetic field generated by a set of magnet fields has substantially the same period length as the periodic magnetic field generated by the other set of magnet arrays.

Figure 2:
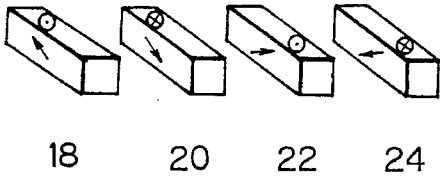
FIG. 2 is a diagram showing an example of the directions of magnetization by the magnets to be used in the present invention.

Any of the conventional methods may be employed to generate a sinusoidal periodic magnetic field on an electron orbit by means of a set of magnet arrays. An illustrative method that can be adopted is described in Onuki, Nucl. Inst. and Methods in Phys. Res. A246 (1986) 94–98. According to an embodiment of the present invention, magnets A having direction of magnetization that are normal to the axis of an electron orbit and which are inclined to the plane of an electron orbit are arranged to form a magnet array. The individual magnets are arranged in such a way that the direction of magnetization by one magnet is opposite to that of magnetization by an adjacent magnet. Two such magnet arrays combine to form a set that generates sinusoidal periodic fields. An example of the directions of magnetization by the magnets used in the present invention is shown in FIG. 2. In the case shown, magnetization occurs in four directions indicated by 18, 20, 22 and 24. To generate periodic fields using those magnets, magnets 18 and 20 having opposite directions of magnetization are arranged alternately to form a magnet array. This magnet array makes a pair with the other magnet array which is composed of similarly alternating magnets 18 and 20. A set of magnet arrays consisting of the magnets arranged in that manner are disposed in positions indicated by 10 and 16 in FIG. 1. The magnet arrays to be disposed in positions indicated by 12 and 14 in FIG. 1 are formed by alternating magnets 22 and 24 which have opposite directions of magnetization. This layout permits sinusoidal periodic fields to be generated on an electron orbit by means of the two sets of magnet arrays. One period of the magnetic fields is formed of either the two magnets 18 and 20 or the two magnets 22 and 24.

The term "the inclination of the direction of magnetization by magnets with respect to the plane of an electron orbit" as used herein means that the direction of magnetization by magnets is inclined by 90 degrees either above or below the plane of an electron orbit. For the purposes of the present invention, the inclination of the direction of magnetization by magnets with respect to the plane of an electron orbit is not limited in any particular way and may be selected as appropriate for the type and luminance of the radiation to be produced. In a preferred embodiment of the invention, the direction of magnetization is either right upward or downward with respect to the plane of an electron orbit.

Figure 3:
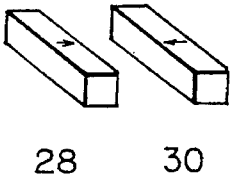
FIG. 3 is a diagram showing another example of the directions of magnetization by the magnets to be used in the present invention.

In another embodiment of the invention, not only the above-described magnets A which have directions of magnetization that are normal to the axis of an electron orbit and which are inclined to the plane of an electron orbit but also magnets B which have directions of magnetization that are parallel to the axis of an electron orbit are employed. This layout not only provides a smooth flow of magnetic flux but also increases the strength of magnetic fields on an electron orbit. In a preferred embodiment of the invention, magnets A are provided alternately with magnets B to form a magnet array. As already described above, magnets A have four directions of magnetization. In contrast, magnets B consist of two kinds of magnets 28 and 30 as shown in FIG. 3. The magnets mentioned above are arranged in the manner described below to construct a magnet array. Magnet 28 is provided next to magnet 18, magnet 20 next to magnet 28, and magnet 30 next to magnet 20; thus, a magnetic field of one period is formed by these four magnets. The four magnets, two of which are magnets A and the others being magnets B, are thus arranged in sequence to make a magnet array. The other magnet array which pairs with this array is formed by arranging the four magnets in sequence in the same way except that the positions of magnets 28 and 30 are interchanged. A set of magnet arrays thus arranged are provided in positions 10 and 16 as shown in FIG. 1.

The magnet array to be disposed in position 12 is formed in the following manner. Magnet 28 is provided next to magnet 22, magnet 24 next to magnet 28, and magnet 30 next to magnet 24; thus, a magnetic field of one period is formed by these four magnets. The four magnets are thus arranged in sequence to make a magnet array. The other magnet array which pairs with this array, namely, the magnet array to be disposed in position 14, is formed by arranging the four magnets in sequence in the same way except that the positions of magnets 28 and 30 are interchanged. Thus, sinusoidal periodic magnetic fields are generated on an electron orbit by means of the two sets of magnet arrays.

The magnets that can be used in the present invention are not limited to any particular type and both permanent and electromagnets can be used as appropriate. Exemplary permanent magnets that can be used include rare-earth cobalt (REC) magnets (e.g., Sm-Co magnet) and Nd-Fe-B magnet. A Nd-Fe-B magnet is preferably used in the present invention. The individual magnets forming magnet arrays and, hence, sets of magnet arrays desirably have substantially the same remanent field.

The greater the number of periods in the sinusoidal periodic magnetic fields to be generated by magnet arrays, the higher the luminance of the radiation produced. In the present invention, the number of periods in magnetic fields is not limited to any particular value but, for practical applications, it is advantageously in the range of from about 5 to about 100. The number of periods in magnetic fields generated by a set of magnet arrays is substantially the same as the number of periods in magnetic fields generated by the other set of magnet arrays, In the present invention, one set of magnet arrays is shifted relative to the other set of magnet arrays along the axis of an electron orbit. As a result, the strengths of the horizontal and vertical components of a periodic magnetic field that is generated on an electron orbit will vary, maintaining the phase difference $\pi/2$ (a quarter of one period). Here it should be noted that the phase difference for each magnet array is not the same as the phase difference for each component of a magnetic field. If the phase difference for each magnet array is written as D, the magnetic field generated on an electron orbit is expressed by:

$$B_x = B_{ax} + B_{bx} = 2A\cos\left(\frac{\pi + D}{2}\right)\sin\left(\frac{2\pi}{\lambda_u} z + \frac{\pi + D}{2}\right)$$

$$B_y = B_{ay} + B_{by} = 2B\cos\left(\frac{D}{2}\right)\sin\left(\frac{2\pi}{\lambda_u} z + \frac{D}{2}\right)$$

where $B_x$ is a horizontal component of the magnetic field, $B_y$ is a vertical component of the magnetic field, z is the distance from the origin of the axis of an electron orbit, and $\lambda_u$ is the period length of the magnetic field. Symbols 2A and 2B denote maximum horizontal and vertical components of the magnetic field on an electron orbit, which vary with the gap distance. The values of A and B are determined by the dimensions of the magnets used and the magnitudes of remanent fields.

To attain the purpose described in the preceding paragraph, the magnetic field generator of the present invention for use with an insertion device is furnished with a means of shifting one set of magnet arrays relative with the other set of magnet arrays along the axis of an electron orbit. If the phase difference is varied, the periodic magnetic field on the axis of an electron orbit varies, whereby the polarization characteristics of the radiation to be produced can be freely changed without limiting the aperture of an electron beam in the horizontal plane. If one wishes to produce a circularly polarized radiation, electrons must undergo a spiral motion. To this end, one set of magnet arrays are shifted in order to generate a spiral magnetic field. If one wishes to produce a linearly polarized radiation, electrons must move while vibrating in a certain plane. To this end, it is necessary to generate a periodic magnetic field the components of which are located only in certain planes including the axis of an electron orbit. The means of shifting magnet arrays in the present invention is not limited in any particular way and any conventional known shifting means may be used. In one embodiment of the invention, magnet arrays are shifted mechanically.

If desired, the distance (or gap) between the two magnet arrays positioned above the plane of an electron orbit and the other two magnets positioned below the plane of an electron orbit may be altered in the present invention. To this end, the magnetic field generator of the present invention for use with an insertion device may further include a gap adjusting means. If the gap is shortened, polarized light at shorter wavelengths can be produced only if shorter length of the period of magnetic field is achieved with sufficiently strong magnetic field on an electron orbit. The period length of magnetic field and its intensity can be related to the wavelength of the resulting radiation as follows:

$$\lambda_1\,[A] = 1.306\,\frac{\lambda_u[mm]}{E^2[GeV]}\left(1 + \frac{K_x^2}{2}\quad\frac{K_y^2}{2}\right)$$

-continued $$K_{x,y} = 93.4\,B_{x,y}\,[T]\,\lambda_u\,[m]$$

where E is the energy of an electron.

Take, for example, the system shown in FIG. 1. In that case, the gap between the combination of magnet arrays 10 and 12 lying above the plane of an electron orbit and that of magnet arrays 14 and 16 lying below the plane of an electron orbit is varied. According to one embodiment of the present invention, the gap is varied by changing the positions of a pair of arrays consisting of arrays 10 and 12 and the other pair of arrays consisting of arrays 14 and 16 in such a manner that the two pair of arrays are moved symmetrically with regard to the axis of the electron orbit 26. The means of varying the gap is not limited in any particular way and any known gap adjusting means may be used. In one embodiment of the present invention, a linear guide and a ball screw are used to vary the gap mechanically.

In the present invention, the distance between adjacent magnet arrays, say, the distance between magnet arrays 10 and 12 or the distance between magnet arrays 14 and 16 is desirably as small as possible. This is because the leakage of magnetic fluxes is sufficiently reduced to achieve efficient generation of magnetic fields.

According to the present invention, periodic magnetic fields can be generated by which radiations having desired polarization characteristics such as circular polarization, elliptic polarization, vertical linear polarization and horizontal linear polarization can be produced on electron orbits.

The magnetic field generator of the present invention for use with an insertion device offers another advantage in that the polarization characteristics of radiation can be freely adjusted by varying the relative positions of the two sets of magnet arrays and that radiation having a wider range of wavelengths than can be picked up from the conventional insertion device for producing circular polarization can be produced by changing the gap between the two sets of magnet arrays.

Since it is possible to fabricate an insertion device having a shorter period length of magnetic fields than the conventional insertion device for producing circular polarization, the present invention enables the production of circularly polarized radiation in the X-ray range. The present invention also permits easy production of linearly polarized radiation in the vertical plane.

A preferred example of the present invention is described below witch reference to accompanying FIGS. 4 and 5.

EXAMPLE

Figure 4:
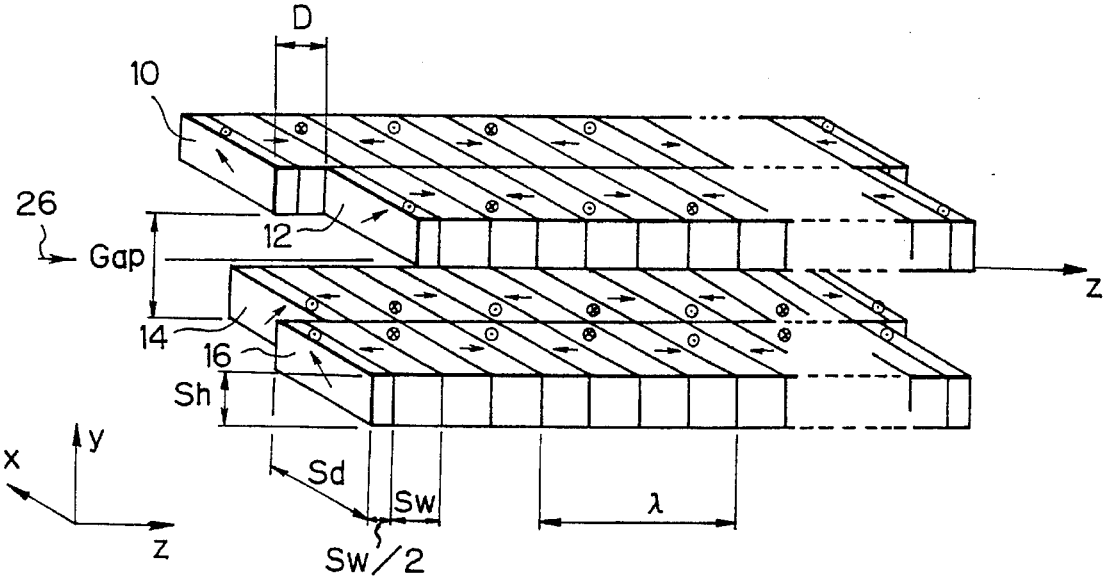
FIG. 4 is a diagram showing schematically the magnetic field generator of the present invention for use with an insertion device.

FIG. 4 shows schematically a magnetic field generator for use with an insertion device according to a preferred embodiment of the invention. The generator consists of four magnet arrays 10, 12, 14 and 16. Each magnet array has magnets disposed in odd-numbered positions that have directions of magnetization that are normal to the axis of an electron orbit and which are inclined with respect to the plane of an electron orbit. Those magnets were inclined by 45 degrees with respect to the horizontal. Each magnet array also has magnets disposed in even-numbered positions that have directions of magnetization parallel to the axis of the electron orbit. As shown in FIG. 2, there are four magnets that are disposed in odd-numbered positions; as shown in FIG. 3, there are two magnets that are disposed in even numbered positions. The magnets used were Nd-Fe-B magnets available from Shin-Etsu Chemical Co., Tokyo, Japan, under the trade name of N-33H. Each of these magnets had Bf of 12 kG and $(BH)_{max}$ of 34 MOe. The dimensions were: Sw=20 mm; Sh=20 mm; Sd=60 mm. The width of the magnets at opposite ends of each magnet array was rendered to be half the value of other magnets in order to adjust the terminal of magnetic fluxes.

In magnet array 10, magnets were arranged in the order of 18, 28, 20 and 30, with one period being formed of these magnets. Since each magnet had a width (Sw) of 20 mm, the period length was 80 mm (20×4). Those magnets were arranged sequentially to provide 6 magnetic periods. Magnet array 16 was formed by arranging magnets in the same manner as described for magnet array 10.

In magnet array 12, magnets were arranged in the order of 22, 28, 24 and 30, with one period being formed of these magnets. The magnets were arranged sequentially to provide 6 magnetic periods. Magnet array 14 was formed by arranging agnets in the same manner as described for magnet array 12.

Periodic magnetic fields are generated on the axis of the electron orbit separately by means of the set of magnet arrays 10 and 16 and by the set of magnet arrays 12 and 14. The gap between the combination of magnet arrays 10 and 12 lying above the plane of the electron orbit and the combination of magnet arrays 14 and 16 lying below the plane of the electron orbit was set at 30 mm.

The generator was set up in a storage ring. Electrons accelerated to 1 GeV were launched into the generator. The set of magnet arrays 12 and 14 was shifted relative to the set of magnet arrays 10 and 16, thereby causing the periodic magnetic fields to vary. The magnet arrays were cantilevered. Phase shifting was done by means of a linear guide and a ball screw. Trajectories of the electron as projected on the X-Y plane are shown in FIG. 5, assuming that D, or the phase difference between magnet arrays is expressed in λ, or the period length of magnetic field. The radiations produced from the system under discussion had wavelengths ranging from about 100 to about 1000 angstroms.

Figure 5:
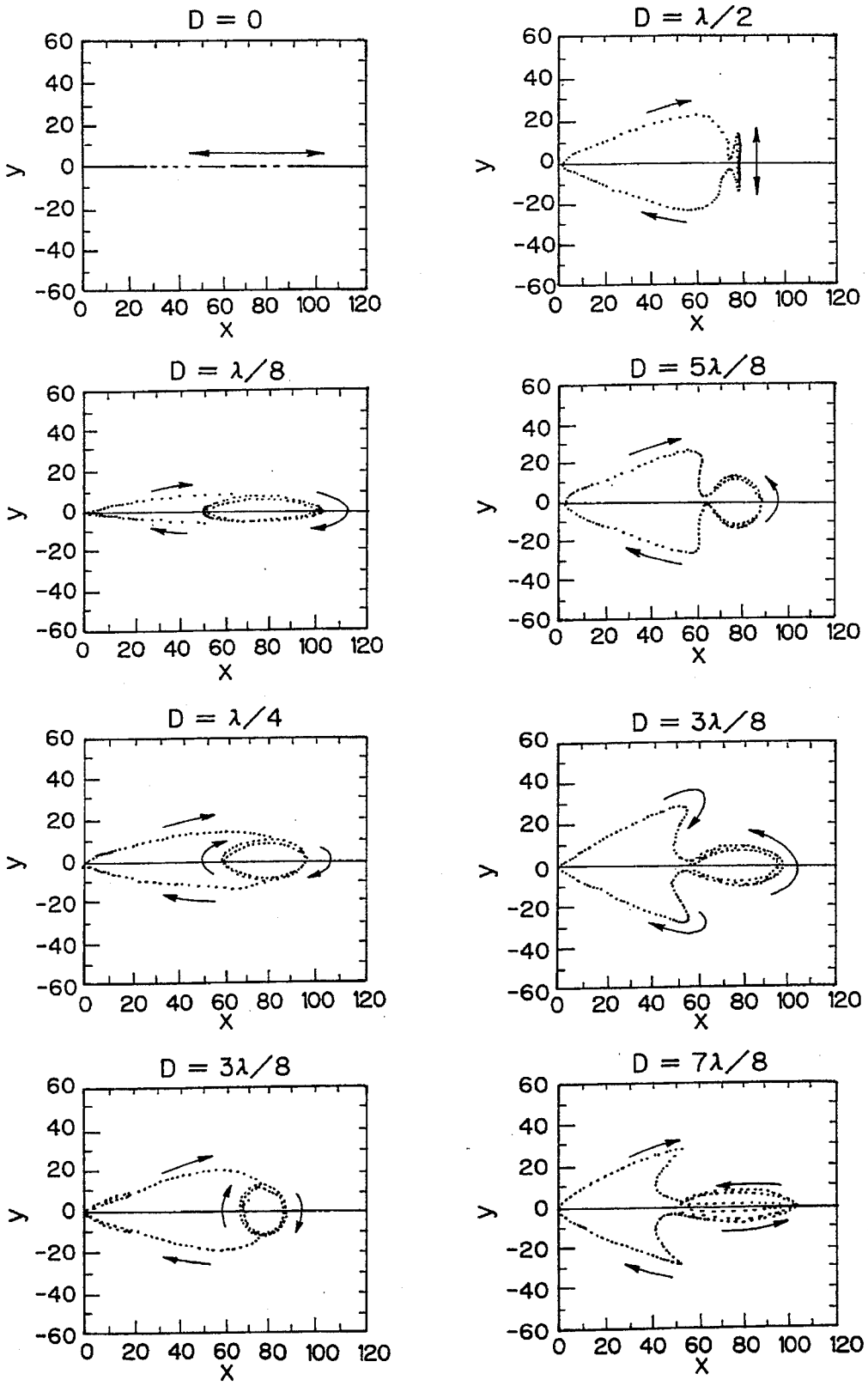
FIG. 5 is a set of diagrams showing trajectories of the electron as projected on the X-Y plane by means of the magnetic field generator of the present invention.

FIG. 5 shows that in the case of D=0 (in phase), electrons described a serpentine trajectory on the X-Y plane, thus producing horizontally linearly polarized radiation. At D=λ/2, electrons described a serpentine trajectory on a plane normal to the plane of an electron orbit, thus producing vertically linearly polarized radiation.

In the case of D=3λ/8 and 5λ/8, electrons described a spiral trajectory in a completely circular form, thus producing circular]y polarized radiation.

When D assumed other values, electrons described a spiral trajectory in an elliptic form, thus producing elliptically polarized radiation.

What is claimed is:

1. A magnetic field generator for use with an insertion device, which comprises four magnet arrays for generating a sinusoidal periodic magnetic field on the axis of an electron orbit, two of said magnet arrays being positioned above the plane of an electron orbit and the other two magnet arrays being positioned below the plane of an electron orbit, said magnet arrays being positioned in such a manner that they are symmetric to each other with respect to the axis of the electron orbit, characterized in that each of said magnet arrays consists of magnets which are normal to the axis of an electron orbit and have the direction of magnetization inclined with respect to the axis of an electron orbit, said magnets alternating with magnets having the direction of magnetization parallel with respect to the axis of an electron orbit; and said magnetic field generator includes a means by which a set of magnet arrays positioned on a diagonal line with respect to the axis of an electron orbit is shifted along the axis of the electron orbit relative to the other set of magnet arrays positioned on a diagonal line with respect to the axis of an electron orbit.

2. A magnetic field generator according to claim 1, wherein the periodic magnetic field has 5 to 100 magnetic periods.

3. A magnetic field generator according to claim 1, wherein the magnets Nd-Fe-B magnets.

4. A magnetic field generator according to claim 1 which is set up within a storage ring.

5. A magnetic field generator according to claim 1 wherein the magnets are Nd-Fe-B magnets.

6. A field magnetic generator according to claim 1 which further includes a means of changing the distance between the two magnet arrays positioned above the plane of the electron orbit and the other two magnet arrays positioned below the plane of the electron orbit.

7. A magnetic field generator according to claim 1 which is set up within a storage ring.

8. A method of generating periodic magnetic fields which include the steps of:

providing two magnet arrays both above and below the plane of an electron orbit, said magnet arrays serving to generate sinusoidal periodic magnetic fields on the axis of the electron orbit and being provided in such a way that they are symmetrical to each other with respect to the axis of the electron orbit; and shifting along the axis of the electron orbit a set of magnet arrays provided on a diagonal line with respect to the axis of the electron orbit relative to the other set of magnet arrays which are also provided on a diagonal line with respect to the axis of the electron orbit.

9. A method according to claim 8 wherein each of said magnet arrays consists of magnets having directions of magnetization that are normal to the axis of the electron orbit and which are inclined with respect to the plane of the electron orbit.

10. A method according to claim 8 wherein each of said magnet arrays consists of magnets having directions of magnetization that are normal to the axis of the electron orbit and which are inclined with respect to the plane of the electron orbit, said magnets alternating with magnets having directions of magnetization parallel to the axis of the electron orbit.

11. A method according to claim 8 wherein the periodic magnetic fields have about 5 to about 100 magnetic periods.

12. A method according to claim 8 which further includes the step of changing the distance between the two magnet arrays positioned above the plane of the electron orbit and the other two magnet arrays positioned below the plane of the electron orbit.

13. A method of generating polarized radiation which comprises the steps of:

providing two magnet arrays both above and below the plane of an electron orbit, said magnet arrays serving to generate sinusoidal periodic magnetic fields on the axis of the electron orbit and being provided in such a way that they are symmetric to each other with respect to the axis of the electron orbit;

shifting along the axis of the electron orbit a set of magnet arrays provided on a diagonal line with respect to the axis of the electron orbit relative to the other set of magnet arrays which are also provided on a diagonal line with respect to the axis of the electron orbit; and launching accelerated electrons into the electron orbit.

14. A method according to claim 13 wherein each of said magnet arrays consists of magnets having directions of magnetization that are normal to the axis of the electron orbit and which are inclined with respect to the plane of the electron orbit.

15. A method according to claim 13 wherein each of said magnet arrays consists of magnets having directions of magnetization that are normal to the axis of the electron orbit and which are inclined with respect to the plane of the electron orbit, said magnets alternating with magnets having directions of magnetization parallel to the axis of the electron orbit.

16. A method according to claim 13 wherein the periodic magnetic fields have about 5 to about 100 magnetic periods.

17. A method according to claim 13 which further includes the step of changing the distance between the two magnet arrays positioned above the plane of the electron orbit and the other two magnet arrays positioned below the plane of the electron orbit.

18. A magnetic field generator for use with an insertion device, which comprises four magnet arrays for generating a sinusoidal periodic magnetic field on the axis of an electron orbit, two of said magnet arrays being positioned above the plane of an electron orbit and the other two magnet arrays being positioned below the plane of an electron orbit, said magnet arrays being positioned in such a manner that they are symmetric to each other with respect to the axis of the electron orbit, characterized in that each of said magnet arrays consists of magnets which are normal to the axis of an electron orbit and have the direction of magnetization inclined with respect to the axis of an electron orbit, said magnets alternating with magnets having the direction of magnetization parallel with respect to the axis of an electron orbit; and said magnetic field generator includes a means by which a set of magnet arrays positioned on a diagonal line with respect to the axis of an electron orbit is shifted along the axis of the electron orbit relative to the other set of magnet arrays positioned on a diagonal line with respect to the axis of an electron orbit;

wherein the ratio of a horizontal magnetic field component and a vertical magnetic field component can be changed by fixing a gap between said magnet arrays.

* * * * *

UNITED STATES PATENT AND TRADEMARK OFFICE

CERTIFICATE OF CORRECTION

PATENT NO.: 5,565,747

DATED: October 15, 1996

INVENTOR(S): Shigemi SASAKI, *et al.*

It is certified that these errors appear in the above-identified patent and that said Letters Patent is hereby corrected as shown below:

On the title page:

In Item [75] Inventors:

Delete "Takeda" and insert --Takada--.

Signed and Sealed this

Eighth Day of August, 2000

*Attest:*

*Attesting Officer*

Q. TODD DICKINSON

*Director of Patents and Trademarks*